US005447436A

United States Patent [19]

Campagnuolo et al.

[11] Patent Number: 5,447,436

[45] Date of Patent: Sep. 5, 1995

[54] APPARATUS AND METHOD OF MAGNETICALLY COUPLING ACOUSTIC SIGNALS INTO A TACTICAL ENGAGEMENT SIMULATION SYSTEM FOR DETECTING INDIRECT FIRE WEAPONS

[75] Inventors: Carl J. Campagnuolo, Potomac; Gene Ferguson, Baltimore, both of Md.

[73] Assignee: The United States of America as represented by the Secretary of the Army, Washington, D.C.

[21] Appl. No.: 141,005

[22] Filed: Oct. 26, 1993

[51] Int. Cl.[6] ..... F41A 33/00

[52] U.S. Cl. ..... 434/11; 102/404; 340/326; 364/423; 273/372

[58] Field of Search ..... 434/11-13, 434/16, 21, 23; 102/201, 211, 401, 402, 410, 411, 432, 447; 364/423, 578; 273/310, 372; 340/326, 385, 435, 903, 943

[56] References Cited

U.S. PATENT DOCUMENTS

| | | | |
|---|---|---|---|
| 4,273,536 | 6/1981 | Wick . | |
| 4,352,665 | 10/1982 | Kimble et al. . | |
| 4,416,631 | 11/1983 | Dawson et al. . | |
| 4,453,161 | 6/1984 | Lemelson . | |
| 4,624,641 | 11/1986 | Gallagher . | |
| 4,654,008 | 3/1987 | Elmore . | |
| 4,682,953 | 7/1987 | Doerfel et al. . | |
| 4,744,761 | 5/1988 | Doerfel et al. . | |
| 4,823,401 | 4/1989 | Gammarino et al. . | |
| 4,948,371 | 8/1990 | Hall . | |
| 5,027,709 | 7/1991 | Zlagle | 434/11 X |
| 5,074,793 | 12/1991 | Hambric et al. . | |
| 5,199,874 | 4/1993 | Campagmuolo et al. | 434/16 X |
| 5,207,579 | 5/1993 | Campagnuolo . | |
| 5,213,503 | 5/1993 | Marshall et al. . | |
| 5,215,463 | 6/1993 | Marshall et al. . | |
| 5,215,464 | 6/1993 | Marshall et al. . | |
| 5,215,465 | 6/1993 | Marshall et al. . | |
| 5,228,854 | 7/1993 | Eldridge | 434/11 |

FOREIGN PATENT DOCUMENTS

| | | | |
|---|---|---|---|
| 2659136 | 9/1991 | France | 434/11 |

*Primary Examiner*—Joe H. Cheng

*Attorney, Agent, or Firm*—Freda L. Krosnick; Frank J. Dynda

[57] ABSTRACT

To simulate the output of a laser to a Multiple Integrated Laser Engagement System (MILES), an electronic circuit having a PLL subcircuit and a microprocessor is used to detect an acoustic signal having a predetermined frequency and pulse rate. Upon detection of the correct acoustic signal, a prestored universal kill code is provided to an inductive loop magnetically coupled to the antenna coil of a harness to which the MILES is integrated. The thus received inductive signal is recognized by the MILES which in turn outputs an audio alarm to indicate that a kill has occurred.

1 Claim, 3 Drawing Sheets

APPARATUS AND METHOD OF MAGNETICALLY COUPLING ACOUSTIC SIGNALS INTO A TACTICAL ENGAGEMENT SIMULATION SYSTEM FOR DETECTING INDIRECT FIRE WEAPONS

RIGHTS OF THE GOVERNMENT

The invention described herein may be manufactured, used and licensed by or for the United Stated Government for governmental purposes without payment to us of any royalty thereon.

FIELD OF THE INVENTION

The present invention relates generally to a tactical engagement simulation system for battlefield training exercises and more particularly to a circuit for magnetically coupling acoustic signals simulating explosions to the tactical engagement simulation system.

BACKGROUND OF THE INVENTION

The Army has in its inventory a training device known as Multiple Integrated Laser Engagement System (MILES). During a battlefield training exercise, each solider is equipped with a Man Worn Laser Detector harness (MWLD) which contains the electronics of MILES that recognize specific laser codes in the 900 nm wavelength region. The codes are generated by laser attached to direct fire weapons, such as for example M16, machine guns, etc. each of which having its own identification code. In order for the MWLD harness to be activated, i.e. register a hit, the laser must be detected by detectors mounted on the MWLD harness. The system works fine for direct fire weapons. However, indirect fire weapons such as grenades and mines would have problems registering a hit due to their indirect orientation. The problem of indirect fire recognition was solved by Harry Diamond Laboratories (HDL) with the development of the Grenade Acoustic Signal Processor (GASP) electronics, which is disclosed in Campagnuolo U.S. Pat. No. 5,199,874, assigned to the same assignee as the instant invention and whose disclosure is incorporated by reference herein.

The '874 invention is applicable to the so-called MILES I which specifically contains a tamper prevent circuit that provides for an audible alarm to be activated upon removal and reinsertion of the MILES power source. Such tamper prevent circuit has not been incorporated into the more advanced MILES II and MILES II/SAWE rf systems, which can retain weapon hit information. However, for the foreseeable future, all three MILES will be used in field training exercises throughout the world. Thus, there now is needed a new system compatible with all three MILES that can detect the acoustic signals generated by the indirect fire weapons.

BRIEF DESCRIPTION OF THE PRESENT INVENTION

So that the indirect fire weapon acoustic signals may be used by all three MILES, the present invention comprises a circuit which communicates by magnetic induction to any of the MILES integrated to the harness strapped to the soldier during field exercises. The invention circuit, enclosed in a receiver box, can be strapped onto the harness at the shoulder position of the soldier, whenever the soldier exercises with grenades or mines whose output is a multidirectional acoustic signal.

Taking advantage of the fact that each harness has incorporated therein an antenna coil, the present invention circuit is designed to inductively provide, via an induction coil to the harness coil, a detected acoustic signal to the MILES. In particular, the invention circuit has a front end microphone for detecting the acoustic signal generated by the indirect fire device. The detected acoustic signal is filtered and amplified by a front end filter and amplifier stage. Thereafter, the signal is provided to a phase lock loop (PLL) circuit which is tuned to a frequency predetermined to represent the indirect fire weapon. Upon detection of the predetermined frequency signal, an output is provided by the PLL circuit to a microprocessor which then outputs a universal kill code to an induction coil positioned adjacent to the antenna coil of the harness. The code from the microprocessor is inductively transferred by the induction coil to the antenna coil and then to the MILES. There, upon recognition of the universal kill code, an alarm is sounded by the MILES to indicate that the soldier wearing the harness has been incapacitated (theoretically hit or killed) by the simulation indirect fire weapon.

An objective of the present invention is therefore to provide a circuit which is adapted to all MILES.

BRIEF DESCRIPTION OF THE FIGURES

The above-mentioned objective and advantages of the present invention will become more apparent and the invention itself will be best understood by reference to the following description of the invention taken in conjunction with the accompanying drawings, wherein.

DETAILED DESCRIPTION OF THE PRESENT INVENTION

There are two factors common to all harnesses of the different MILES. First, each harness contains photodetectors that, upon receipt of a laser pulse, sends a signal to the MILES to emit a kill code, for example an audio alarm. The photodetectors are therefore meant to be used with direct aim simulation weapons such as laser M16s. The second feature which is common to all harnesses is the incorporation of a magnetic loop, i.e. an antenna coil, in each harness. The antenna coil was originally designed to recognize a hit signal received by a head harness strapped to the helmet of a soldier which also contains photodetectors. The photodetectors, with appropriate filters, would detect signals in the 900 nm wavelength range which are generated by lasers mounted on direct fire weapons that emit specific coded information when energized. The coded information is processed by the electronics in the MILES fitted to the MWLD harness. If the code is recognized, the MILES is activated by sounding a buzzer which signifies a hit. The photodetectors however are not adaptable to detect multidirectional signals, such as acoustic signals that are generated by indirect fire weapons such as the grenade disclosed in the '874 patent.

To enable the MILES to register a kill, or incapacitation, of an object such as a soldier or a vehicle that has strapped thereto a harness, the present invention circuit would electronically create a universal laser killer code, which when activated by the predefined acoustic signal of an indirect fire weapon is coupled through a magnetic induction loop into the MILES to thereby activate the MILES to signify a hit. For the instant invention, no interconnection is therefore required between the circuit and the MILES harness worn by a soldier.

Figure 1:
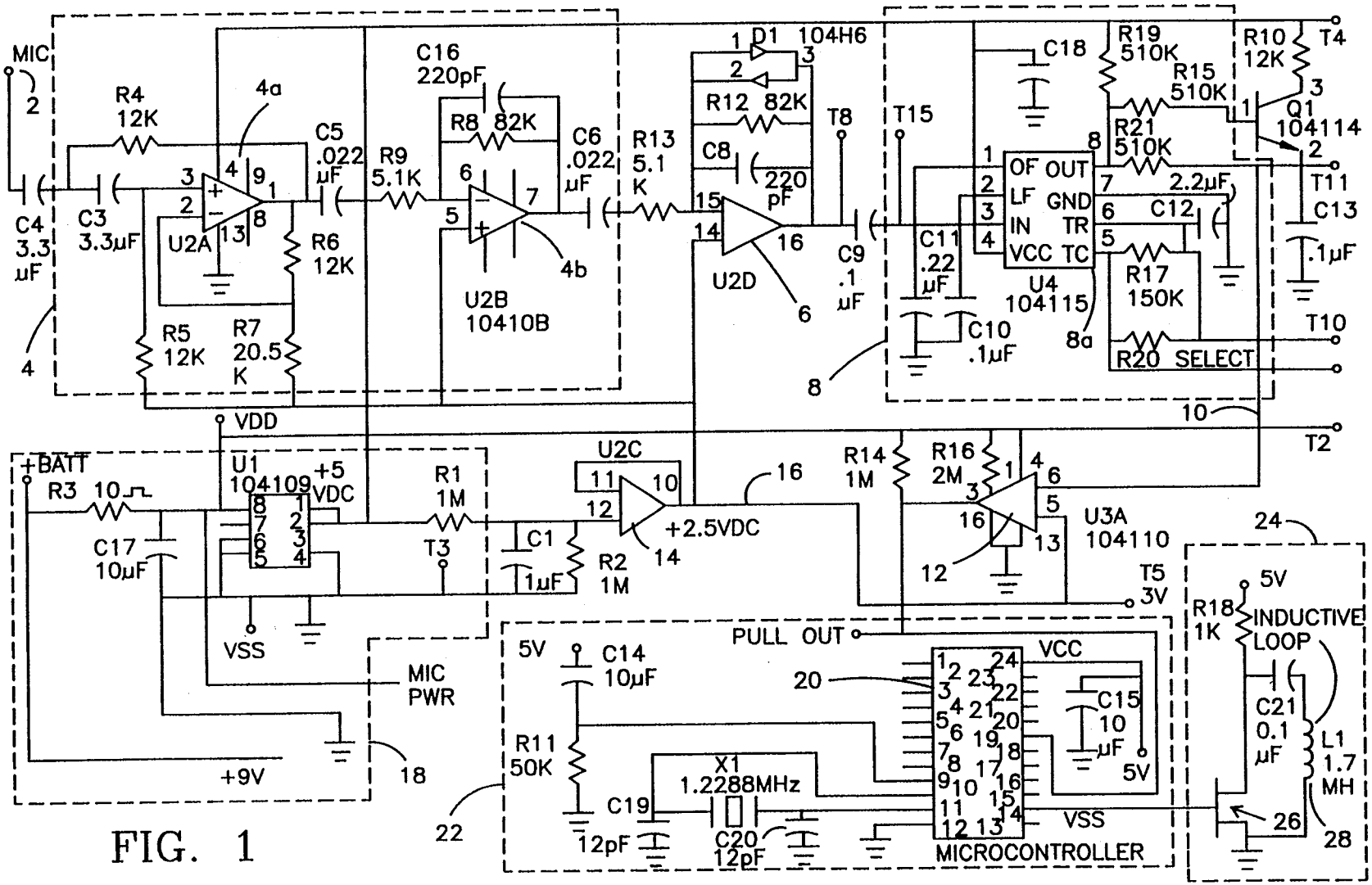
FIG. 1 is a schematic of the circuit of the instant invention.

A particular embodiment of the present invention circuit is illustrated in FIG. 1. As shown, the FIG. 1 circuit includes a microphone 2 for detecting acoustic signals generated from an indirect fire weapon such as the aforenoted grenade of the '874 patent. The detected acoustic signal is sent from a microphone 2 to a filter circuit 4 which comprises operation amps 4*a* and 4*b*. Filters 4*a* and 4*b* may be tuned to frequencies of 10 KHz and 2 KHz, respectively. Thus filtered, the signal is fed to op amp 6 which acts as a gain stage for amplifying the signal. The thus amplified signal is next fed to a phase lock loop (PLL) circuit 8 which includes a conventional phase lock loop IC 8*a*. Since each sound has a discrete frequency with its own associated modulation, for the instant embodiment, PLL circuit 8 may be tuned, by means of capacitors C10 and C11, to a frequency of approximately 3750 Hz having pulse durations of approximately 67 msec on and 65 msec off. Thus, when IC 8*a* senses transitions of the signal a number of times (for example four times), it would provide an output at its pin 8, i.e. on line 10 and also at output T11. The output from PLL circuit 8 on line 10 is fed to a comparator 12, which is referenced to a given operating voltage by op amp 14 via line 16. The output from comparator 12 is provided as an input to microprocessor 20 of processing circuit 22. Further shown are a voltage regulator circuit 18 which provides a regulated voltage for the system and a transistor $Q_1$, which together with capacitor C13, provides chatter protection for the circuit.

The microprocessor may be any conventional processor and for the instant embodiment is a 68HC705K processor by the Motorola Company. Upon receipt of a valid signal from PLL circuit 8 (via comparator 12), microprocessor 20 would output a signal to induction coil 24, and specifically to FET 26 to activate the same. Upon activation, the signal (a universal kill code provided in a digital bit stream) is inductively provided by induction coil 28 to the antenna coil (not shown) integrated to the harness. The output data stream from microprocessor 20 is recognized by the MILES and, if a correspondence is made, a signal (for example an audible sound) indicating that the soldier wearing the harness has been "hit" by the indirect fire weapon is provided by the MILES.

Figure 2:
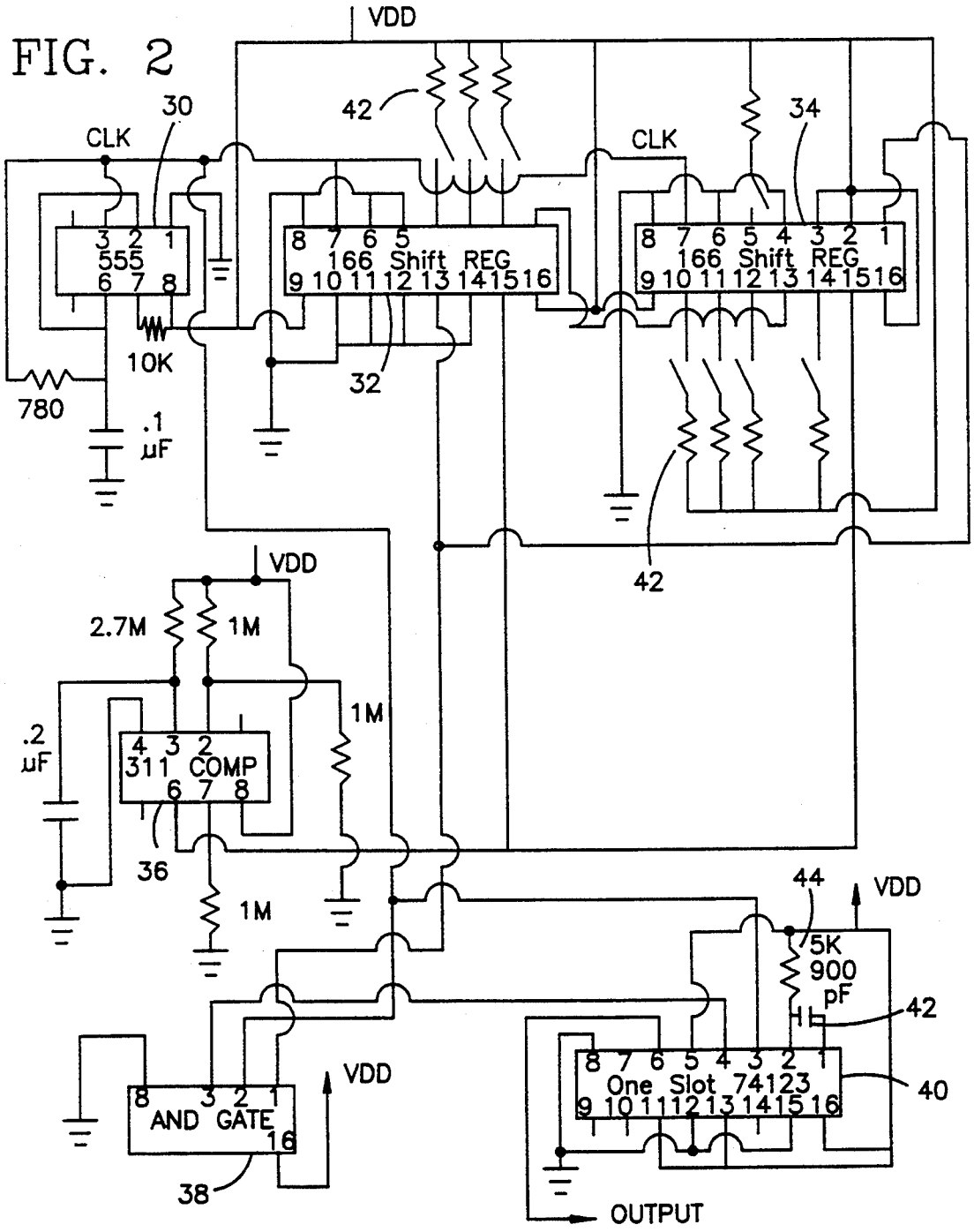
FIG. 2 is a schematic of a component circuit to illustrate the functions of the microprocessor of the FIG. 1 circuit.

The functional operation of microprocessor 20 is illustrated by and discussed below with reference to the discrete components of the FIG. 2 circuit. In particular, as shown, a 555 timer 30 provides clock pulses for the circuit. The output of timer 30 is provided to two series connected shift registers 32 and 34. Also shown is a comparator 36, an AND gate 38 and a multivibrator (one shot) 40. Comparator 36 may be a LM311 comparator and is used to hold pin 15 of shift registers 32 and 34 low, thereby allowing parallel loading of an 11 bit code, such as for example that shown in FIG. 3, into the input ports of the shift registers. This 11 bit code could be representative of the signature of a particular one of the indirect fire weapons. (However, for this embodiment this code is assumed to be the universal kill code). The code is a redundant code since the MILES can begin detection of any portion thereof. For the discussion of the FIG. 2 circuit, the loading of the code into the shift registers assumes that the predetermined acoustic signal of a particular indirect fire weapon has been detected. Each of the shift registers is an 8 bit register. Together, these series connected shift registers can therefore accommodate 16 bits and in fact provide accommodation for the 11 bit code. The remaining 4 bits of the two shift registers are set to 0.

Figure 3:
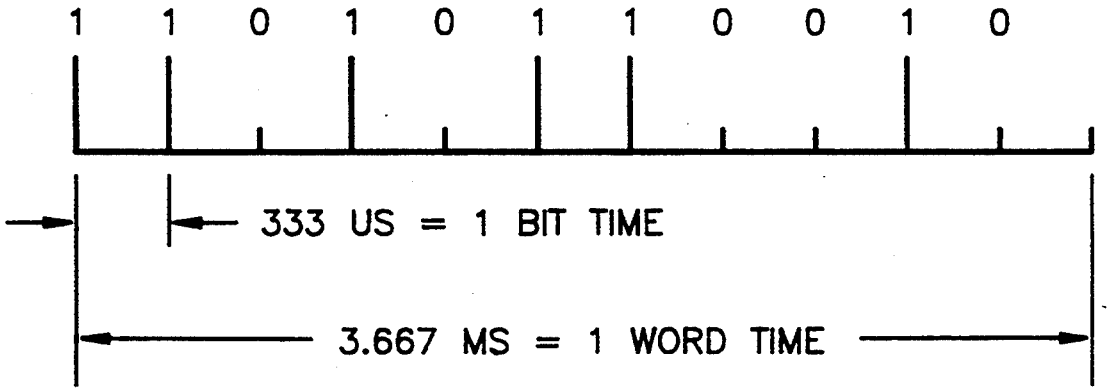
FIG. 3 is a representation of a binary code to be used with the FIG. 1 circuit and the explanation of the FIG. 2 circuit.

Thus, when power is applied to the circuit, a predefined universal kill code, for example the hexadecimal value code of FIG. 3, is loaded in parallel into shift registers 32 and 34. For the exemplar binary code shown in FIG. 3, the three leftmost bits, i.e. 110, together provide a MILES identification code. In other words, in order for the electronically generally code to be detected, MILES has to first detect an input of 110. Since timing for MILES is critical, the transmission rate, i.e. the rate at which the data is shifted serially to the output port of the shift registers, for the instant embodiment, needs to be at 3 KHz with a 333 $\mu$s time interval between successive bits, and thereby a word length of 3.67 ms comprising 11 bits. To provide for detection, each bit has to have a 100 to 150 $\mu$sec pulse width, met by the delay provided by the shift registers which begin shifting on the rising edge of each clock pulse to ensure that two adjacent high pulses can be detected. The output of the AND gate 36 is fed to one shot 40, which sets the pulse width by adjusting the values of capacitor 42 and resistor 44 at its pins 1 and 2.

In operation, the code is first parallel loaded into shift registers 32 and 34, with comparator holding pin 15 of those shift registers low for about 0.1 second. Once pin 15 or the respective shift registers are switched to high, the serial shifting of the bit data by the series connected shift registers 32 and 34 begins. The timing of the system is controlled by the 555 timer 30, which is set at 3 KHz. The correct pulse width of each pulse of the data stream is regulated by one shot 40, as the pulses are fed to induction loop 28 (FIG. 1 ). Further, the component circuit of FIG. 2 is activated by the output of comparator 12 of FIG. 1, as it should be when the corresponding functions of the FIG. 2 components are incorporated into microprocessor 20 of the FIG. 1 circuit. Of course, comparator 12 remains low until PLL circuit 8 detects an acoustic signal with the correct predetermined frequency and pulse rate.

With specific reference to microprocessor 20, in addition to incorporating the functions of the components shown in and discussed above with reference to the FIG. 2 circuit, for the instant embodiment, microprocessor 20 is also programmed to sense 8 low pulses before FET 26 is activated and the laser code (the universal kill code) is provided to inductive loop 28. The 8 low pulses are generated by comparator 12 when a viable acoustic signal is detected by PLL circuit 8. As should be appreciated, the laser code, for example the code shown in FIG. 3 is prestored into the internal ROM (or external RAM) of microprocessor 20.

With the thus produced laser code, the antenna coil (inductive loop) integrated into the MWLD harness will activate the MILES attached thereto whenever a valid acoustic signal is received. Thus activated, the MILES provides an alarm signal, for example an audible buzzer, to indicate that the appropriate acoustic signal representative of a hit or kill has been detected.

A second aspect of the invention entails the direct input of the laser code from microprocessor 20 to the MILES without magnetic coupling. Such embodiment is used in the instance where a harness is strapped to a vehicle which does not include an antenna coil. For that particular harness, instead of providing a signal to activate an induction coil, the signal output from microprocessor 20 is directly fed to the MILES secured to the harness to thereby directly provide thereto the laser code.

Inasmuch as the present invention is subject to many variations, modifications and changes in detail, it is intended that all matter described throughout the specification and shown in the accompanying drawings be interpreted as illustrative only and not in a limiting sense. Accordingly, it is intended that the invention be limited only by the spirit and scope of the hereto appended claims.

We claim:

1. Apparatus magnetically coupled to a MILES-type tactical engagement simulation system having a magnetic loop, comprising:

means for detecting a multi-directional acoustic signal having a predetermined frequency;

means for converting said detected multi-directional acoustic signal to a first electrical signal;

an induction coil means magnetically coupled to said magnetic loop;

phase lock loop means for outputting a second electrical signal in response to said first electrical signal to said induction coil means upon detection of said predetermined frequency in said first electrical signal;

wherein said induction coil means magnetically couples said second electrical signal to said system to thereby cause said system to output an audible alarm to indicate that an object carrying said system and said apparatus has been hit and further wherein said second electrical signal comprises a universal kill code and wherein no physical interconnection is therefore required between said system and said apparatus.

* * * * *